US006163920A

United States Patent [19]

Meyer

[11] Patent Number: 6,163,920

[45] Date of Patent: Dec. 26, 2000

[54] PAINT BRUSH ACCESSORY

[75] Inventor: Barbara Meyer, Otterville, Canada

[73] Assignee: Frank Meyer, Milford, Mich.

[21] Appl. No.: 09/061,399

[22] Filed: Apr. 16, 1998

[51] Int. Cl.[7] ..... A46B 17/02; A46B 17/00

[52] U.S. Cl. ..... 15/248.1; 15/246

[58] Field of Search ..... 15/246, 166, 248.1; 401/14, 15, 48, 193

[56] References Cited

U.S. PATENT DOCUMENTS

| | | |
|---|---|---|
| 2,610,344 | 9/1952 | Gaffer et al. . |
| 2,820,237 | 1/1958 | Maslaney . |
| 2,900,657 | 8/1959 | Gruden, Jr. . |
| 3,037,231 | 6/1962 | Kurschner . |
| 3,049,741 | 8/1962 | Bessette et al. . |
| 3,210,791 | 10/1965 | Rogholt . |
| 3,337,894 | 8/1967 | Compton, Jr. . |
| 3,698,033 | 10/1972 | French . |
| 3,824,647 | 7/1974 | Deck et al. . |
| 3,930,278 | 1/1976 | Nasca . |
| 4,004,318 | 1/1977 | Balkus, Jr. . |
| 4,128,913 | 12/1978 | Scholl . |
| 4,202,105 | 5/1980 | Hogle . |
| 4,705,418 | 11/1987 | Van Wesenbeeck . |
| 5,134,747 | 8/1992 | Roesler . |

FOREIGN PATENT DOCUMENTS

| | | |
|---|---|---|
| 2225528 | 6/1990 | United Kingdom . |

*Primary Examiner*—Deborah Jones
*Assistant Examiner*—Jennifer McNeil
*Attorney, Agent, or Firm*—Young & Basile, Pc

[57] ABSTRACT

A paint brush accessory mountable on a paint brush includes a planar shield having a first edge and an opposed second end. A guide is carried on the shield adjacent the first edge for sliding engagement with a surface or edge to enable the shield to be guided in a straight line at an angle along the surface or edge. The guide is formed with an exterior surface disposed at an angle with respect to the plane of the shield to hold the shield at a constant angle from an adjoining wall when the first edge of the shield in engaged with a surface or edge. A holder is pivotally coupled to the second end of the shield to enable pivotal movement of the first end of the shield between a first position adjacent the bristles of a paint brush and a second position spaced from the bristles. The holder is releasibly mountable on the paint brush handle.

9 Claims, 2 Drawing Sheets

PAINT BRUSH ACCESSORY

BACKGROUND OF THE INVENTION

1. Field of the Invention

The present invention relates, in general, to painting and, more specifically, to paint brush guides and shields.

2. Description of the Art

While painting walls, ceilings, moldings, etc. it is frequently necessary to paint a straight edge between two abutting surfaces, such as an edge between two walls, one wall and a ceiling, or between a trim molding and a wall. Since this is difficult to do freehand, even by the most experienced painter, various devices have been developed to enable a painter to easily paint a straight line along an edge.

Painter's tape having a width of one inch or more is typically applied on the surface which is not to be painted. While the tape will keep paint from being applied to the surface which is not to be painted, the application of the tape to the wall or surface is time consuming, difficult to apply evenly in a straight line along the edge, and difficult to prevent the seepage of paint beneath the edge of the tape onto the surface which is not to be painted.

Shields in the form of a thin plastic member have also been slid along the edge as a barrier to keep paint from a paint brush on one side of the shield and off of the adjoining surface which is not to be painted. However, the use of such shields with a paint brush require two hands and a simultaneous coordinated movement of the shield and paint brush along an edge. This is difficult to do by inexperienced painters. Further, even for an experienced painter, the simultaneous movement of the paint brush and shield is difficult in certain conditions, such as along the edge of a ceiling, in narrow spaces, etc.

Other guides have been devised which are mountable on a paint brush, typically on the metal collar or ferrule between the handle and the bristles. Such guides are adapted to engage and slide along an edge to enable a painter to move the paint brush in a straight line and to apply paint evenly along the edge with only one hand.

Such guides have also been designed with a pivotal or other movement which moves the guide to be swung away from the bristles to enable the bristles to be dipped into a supply of paint without getting paint on the guide.

However, such guides are still angularly movable when engaging an edge between two adjacent wall or other surfaces thereby making it difficult to apply paint from the brush in a straight line along the edge.

Thus, it would be desirable to provide a paint brush accessory which provides the dual functions of an edge guide and a paint shield. It would also be desirable to provide a paint brush guide and shield which is attachable to different width paint brushes and which can also be adjusted longitudinally aligned the longitudinal axis of the paint brush for advantageous use in different painting conditions. It would also be desirable to provide a paint brush guide and shield which is capable of maintaining the paint brush at a constant angle with respect to an edge during an application of paint along the edge.

SUMMARY OF THE INVENTION

The present invention is a paint brush accessory or guide and shield which is mountable on a paint brush to enable a painter to move the paint brush in a straight line along a surface or an edge between two adjoining wall and/or molding surfaces while providing the dual functions of guiding the paint brush in the straight line as well as shielding paint from the paint brush bristles from an adjacent surface which is not to be painted.

In a preferred embodiment, the paint accessory includes a shield having first and second ends, means carried on the shield for guiding the paint brush along a surface or edge, and attachment means, coupled to the shield, for attaching the shield to a paint brush.

Preferably the guiding means comprises a projection extending from the shield and located generally adjacent the first end of the shield. The projection has an exterior surface disposed at a predetermined angle with respect to the plane of the shield. In a preferred embodiment, the exterior surface is disposed at a 45° angle with respect to the plane of the shield. The edge of the exterior surface of the projection is preferably beveled and spaced from the adjoining first edge of the shield.

The attachment means preferably comprises a holder releasibly mountable on a paint brush handle and means for coupling the shield to the holder. The coupling means preferably pivotally couples the shield to the holder for movement of the shield between a first position in which the first edge of the shield is disposed adjacent to the bristles of the paint brush, and a second position wherein the first edge of the shield is spaced from the paint brush bristles to enable more paint to be applied to the bristles.

Means are also provided for adjustably mounting the holder on a paint brush handle. The adjustably mounting means includes a slot formed in the holder which receives a fastener mountingly engagable with the paint brush handle. The slot is elongated to enable the longitudinal position of the first edge of the shield to be repositioned as desired with respect to the edge of the paint brush bristles.

Preferably, the shield has a triangular shape extending from a wider first edge which extends outward beyond the sides of the paint brush bristles to shield paint on the bristles from being applied to an adjoining surface on the other side of the shield.

The paint accessory of the present invention provides the dual functions of enabling a painter to guide a paint brush in a straight line along a surface, such as an edge between two adjoining walls, moldings, ceiling, etc. while at the same time shielding paint on the paint brush bristles from being applied to an adjoining surface which is not to be painted. The paint brush accessory uniquely includes a separate guide on the shield which has an exterior surface disposed at a predetermined angle to the shield to dispose the shield at an angle from the edge between two adjoining surfaces to enable the shield to prevent paint from being applied to the surface which is not to be painted and at the same time insuring that the shield is moved in a straight line along the edge between the two adjoining surfaces.

The paint brush accessory of the present invention is also releasibly mountable on a paint brush and may be longitudinally adjusted in position for use in different applications. Finally, the present paint or brush accessory is movable between a first use position adjacent to the bristles of a paint brush and a second, non-use position spaced from the paint brush bristles to enable the bristles to be dipped into a paint supply, such as a paint can.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENT

Figure 1:
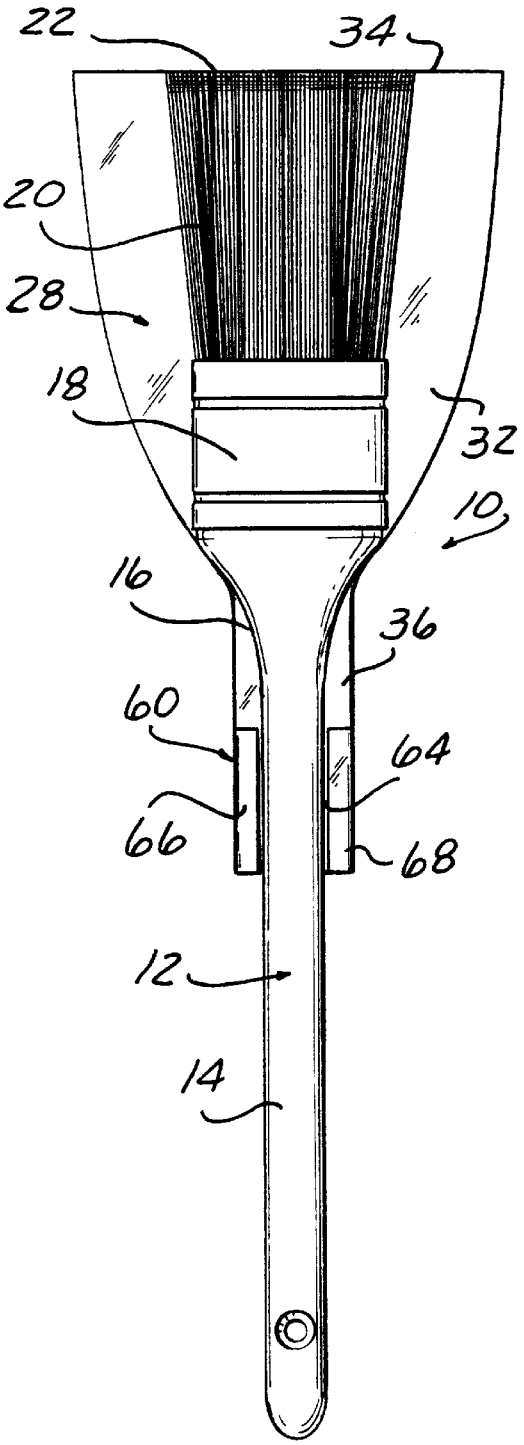
FIG. 1 is a bottom elevational view of a paint brush accessory according to the present invention mounted on a paint brush.

Referring now to the drawings, and to FIGS. 1–5 in particular, there is depicted a paint brush accessory 10 which enables a painter to paint a straight line, such as along an edge between two adjoining surfaces, i.e., two adjoining walls, a wall and a ceiling, a wall and a molding, etc.

In general, the paint brush accessory 10 is attachable to any conventional paint brush. As is well known, a paint brush 12 has an elongated handle 14 which narrows adjacent one end into a smaller width neck before expanding outward at the one end. A metal collar or ferrule 18 is mounted on the one end to secure bristles 20 to the handle 14. The bristles 20 terminate in a straight edge 22 which is perpendicular to the longitudinal axis of paint brush 12. Such paint brushes 12 are provided in a variety of widths each containing an appropriately varying mass of bristles 20.

The paint brush accessory 10 of the present invention includes a shield 28 and a guide 30. The shield 28 is preferably formed of a lightweight material, such as plastic. It will be understood, however, that the shield 28 may be formed of any other material, including metal, wood, etc.

The shield 28 has a generally triangular portion 32 extending from a larger width first end or edge 34 to an opposite end of smaller width which merges into a generally rectangular, straight sided portion 36 which terminates in a second end 38. The triangular portion 32 of the shield 28 has a generally constant thickness from the first edge 34 to the opposed end at the straight sided portion 36.

Figure 2:
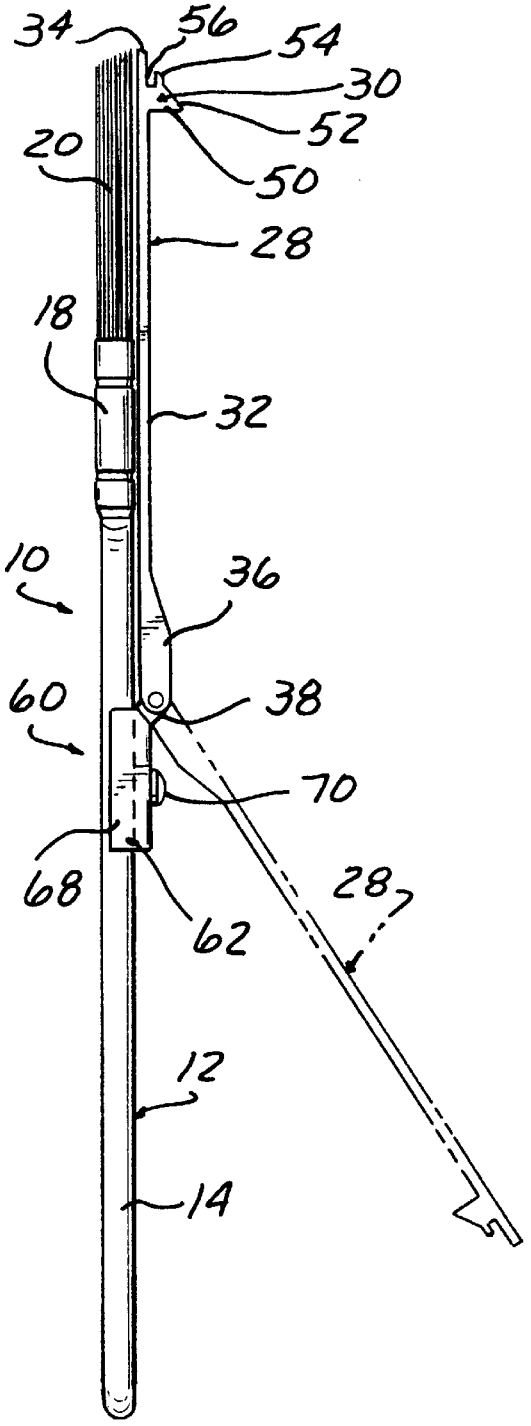
FIG. 2 is a side elevational view of the paint brush accessory shown in FIG. 1.
Figure 3:
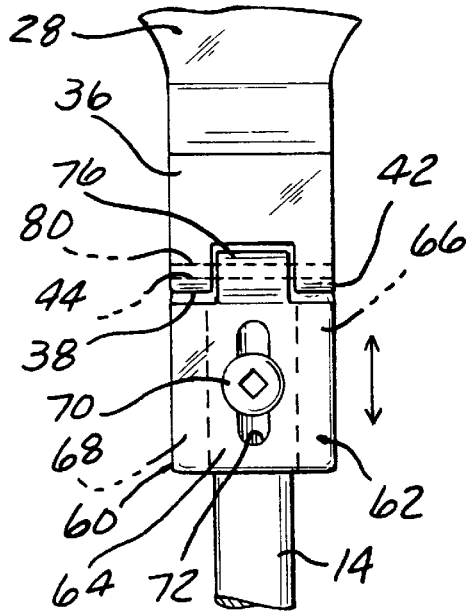
FIG. 3 is a partial, plan view of the attachment and pivoting means of the paint brush accessory of the present invention.
Figure 4:
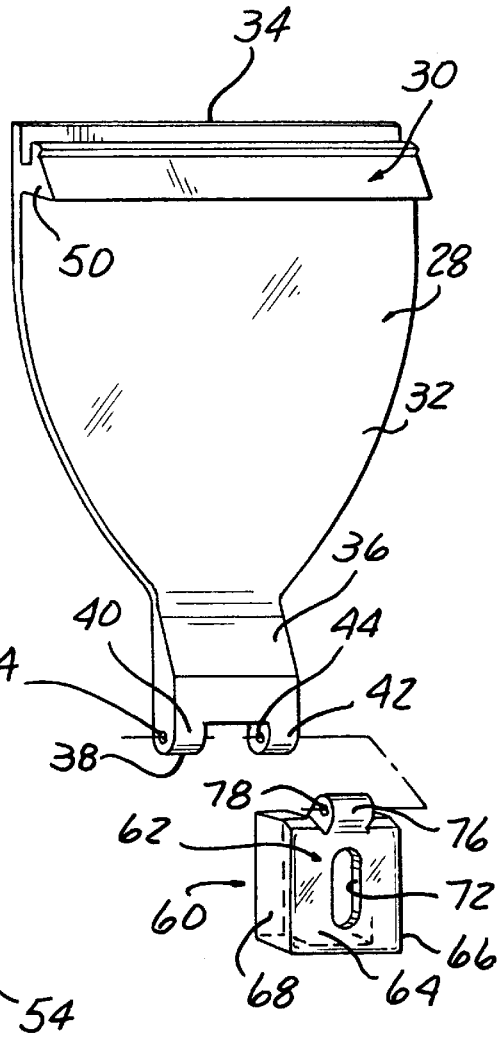
FIG. 4 is an exploded, perspective view of the paint brush accessory of the present invention.

As shown in FIGS. 2 and 4, the straight sided portion 36 has an enlargement tapering outward from the plane of the triangular portion 32 to the second end 38 of the shield 28. As shown in FIG. 4, the second end 38 of the shield 28 which is part of the straight sided portion 36 of the shield 28 terminates in a fork formed of spaced legs 40 and 42 separated by a notch or aperture. Aligned bores 44 are formed in the legs 40 and 42 and form part of a pivoting means as described hereafter.

The guide 30 is disposed adjacent the first edge 34 of the shield 28 as shown in FIGS. 2 and 4. The guide 30 includes a projection 50 extending outward from one surface of the shield 28 opposite from the surface disposed adjacent to the bristles 20 of a paint brush 12 when the accessory 10 is mounted on a paint brush 12. Preferably, the projection 50 is integrally formed with the shield 28 such as by integral molding with the shield 28.

The projection 50 has an outer surface 52 spaced from the shield 28. Preferably, the outer surface 52 is disposed at a predetermined angle to the plane of the shield 28, such as a preferred 45° angle. This particular angular disposition of the outer surface 52 of the projection 50 maintains the shield 28 and the attached paint brush 12 at an optimum angle between two surfaces when the shield 28 is moved along an edge between the two adjoining surfaces as described hereafter.

Further, in an exemplary embodiment, the forwardmost edge 54 of the outer surface 52 of the projection 50 is beveled or disposed at a larger angle with respect to the shield 28 for clearance in engaging the shield 28 and the guide 30 with an edge. A clearance notch 56 is also formed between the edge 54 and the adjacent first edge 34 of the shield 28 as clearly shown in FIG. 2.

The paint brush accessory 10 also includes attachment means 60 for releasibly mounting the accessory 10 to the handle 14 of the paint brush 12. The attachment means 60 is preferably in the form of a holder 62 exemplary formed of plastic or other suitable material. The holder 62 has a generally U-shaped cross section formed of a central, planar wall 64 and two opposed side walls 66 and 68 projecting from one side of the central wall 64.

The side walls 66 and 68 are spaced apart a predetermined distance to enable the holder 62 to be releasibly mounted over the handle 14 of a paint brush 12 generally adjacent to the neck 16 of the handle 14. It will be understood that the holder 62 may be provided in different widths to vary the spacing between the side walls 66 and 68 and to enable the holder 62 to be mounted on paint brushes 12 having different width handles 14.

The holder 62 is releasibly mounted on the handle 14 of a paint brush 12 by a fastener 70, such as a threaded screw, which is threadably mounted in the handle 14 of the paint brush 12. The fastener or screw 70 extends through a slot 72 formed in the central wall 64 of the holder 62. The slot 72 extends longitudinally along the length of the holder 62 and is generally coaxial with the longitudinal axis of the handle 14 of the paint brush 12. This enables the longitudinal position of the entire paint brush accessory 10 to be adjusted relative to the handle 14 to move the first edge 34 of the shield 28 into a desired position relative to the edge 22 of the bristles 20 on the paint brush 12.

A boss 76 projects from one end of the holder 62 in a generally outward, angular fashion from the central wall 64. The boss 76 is disposed in the notch between the legs 40 and 42 of the shield 28 and has a through bore 78 which is alignable with the bores 44 in the legs 40 and 42 of the shield 28. A pivot pin 80 is inserted through the aligned bores 44 and 78 to pivotally interconnect the shield 28 to the holder 62. This connection not only connects the shield 28 to the holder 62; but also provides for pivotal movement of the shield 28 from a first, use position, shown in solid in FIG. 2, in which the first edge 34 of the shield 28 is disposed adjacent to the edge 22 of the bristles 20 of the paint brush 12 and the guide 30 is positioned for engagement with an edge between two surfaces, and a second position, shown in phantom in FIG. 2, in which the shield 28 is pivoted away from the bristles 20 of the paint brush 12 to enable the bristles 20 to be dipped into a paint supply for applying additional paint to the bristles 20.

The pin 80 engages the bores 44 and 78 in the legs 40 and 42 and the boss 76 in a friction fit to retain the shield 28 in any selected angular position while still enabling pivoting of the shield 28 as described herein.

In use, the longitudinal position of the shield 28 is adjusted with respect to the handle 14 of the paint brush 12 by means of the threaded fastener or screw 70 and the slot 72 in the holder 62 to position the first edge 34 of the shield 28 generally in line and parallel to the edge 22 of the bristles 20 of the paint brush 12.

Figure 5:
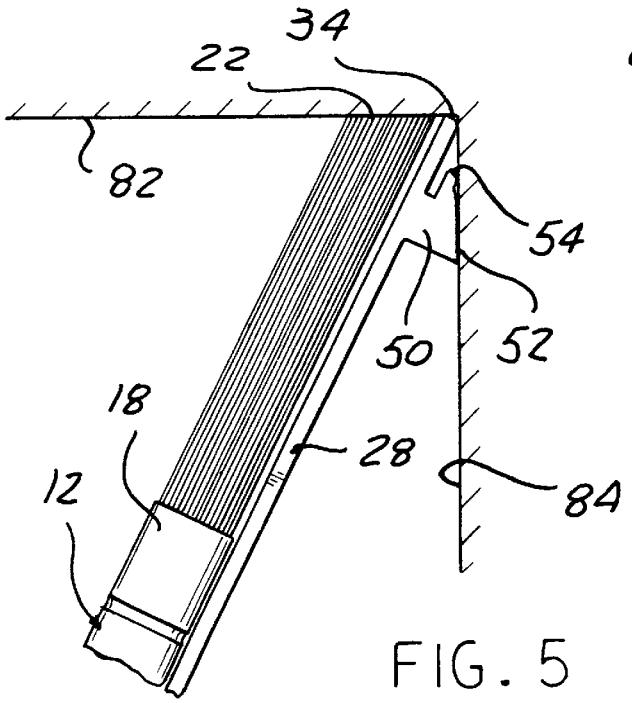
FIG. 5 is an enlarged, plan view showing the paint brush accessory in a use position.

The first edge 34 of the shield 28 is then engaged with the edge between two surfaces, such as the two wall surfaces 82 and 84 shown in FIG. 5. The paint brush 12 is then pivoted about the joined first edge 34 and the edge between the wall surfaces 82 and 84 to an approximate 45° angle from each wall surface 82 and 84 to bring the outer surface 52 of the projection 50 into engagement with the wall surface 84 which is not to be painted. The paint brush 12 is then slid along the edge between the wall surfaces 82 and 84 through engagement between the wall edge and the first edge 34 of the shield 28 and sliding engagement of the outer surface 52 of the projection 30 to enable paint to be applied to the wall surface 82 in a straight line along the edge without the application of paint to the wall surface 84.

When it is necessary to apply more paint to the bristles 20 on the paint brush 12, the shield 28 is pivoted about the holder 62 to the second position shown in phantom in FIG. 2 to enable the bristles 20 to be dipped into a paint supply, such as a paint can.

In summary, there has been disclosed a unique paint brush accessory which enables a painter to easily apply paint in a straight line along an edge between two adjoining surfaces. The paint brush accessory is providable in different widths for attachment to different size paint brushes. The paint brush accessory of the present invention is also longitudinally adjustable along the paint brush handle for use in different painting applications. Finally, the present paint brush accessory provides the dual functions of both shielding paint from a surface which is not to be painted as well as enabling a paint brush to be guided in a straight line along an edge, such as in a straight line along an edge between two adjoining surfaces, walls, etc.

What is claimed is:

1. A paint brush accessory attachable to a handle of a paint brush having bristles terminating in an edge, the accessory comprising:

a shield having first and second opposed ends, the first end terminating in a first edge engagable with an edge between two adjacent surfaces, one of which is to be painted;

means, coupled to the shield, for attaching the shield to a paint brush;

a projection carried on the first end of the shield, the projection having an exterior surface disposed at an angle with respect to a plane of the shield, the exterior surface of the projection adapted to engage and guide the shield along one of the surfaces adjacent to the surface engagable by the bristles of the paint brush at a constant angle from the surface, the exterior surface terminating in a second edge spaced from the first;

the first edge of the shield extending substantially between opposed side edges of the first end of the shield;

the second edge extending substantially between opposed side edges of the projection; and a notch formed in the projection and extending between the first and second edges the notch having an open end disposed between the first and second edges.

2. The accessory of claim 1 wherein the exterior surface of the projection is disposed at a substantially 45° angle with respect to the plane of the shield.

3. The accessory of claim 1 wherein the second edge on the exterior surface of the projection is beveled.

4. The accessory of claim 1 wherein:

the shield has a triangular portion extending from a wider first end to an opposed narrower second end.

5. The accessory of claim 1 wherein the attaching means comprises:

a holder adapted to be releasably mountable on a paint brush handle; and means for coupling the shield to the holder, the coupling means including:

means for manually pivotally coupling the shield to the holder for manual movement of the shield toward and away from bristles of a paint brush.

6. The accessory of claim 5 wherein the holder comprises:

a central wall having two spaced, outwardly extending side walls disposable about a handle of a paint brush.

7. The accessory of claim 5 wherein the pivotally coupling means comprises:

a pin mounted in interlocking portions of the shield and the holder.

8. The accessory of claim 5 further comprising:

means for adjustably mounting the holder on a paint brush handle.

9. The accessory of claim 8 wherein the adjustably mounting means comprises:

a slot formed in the holder; and a fastener extendable through the slot into a paint brush handle.

* * * * *